US009610517B2

(12) United States Patent
Grand et al.

(10) Patent No.: US 9,610,517 B2
(45) Date of Patent: Apr. 4, 2017

(54) BASE MODULE FOR A STARTING APPARATUS OF BOAT COMPETITIONS

(71) Applicant: Polaritas-GM Kft., Budapest (HU)

(72) Inventors: Jozsef Grand, Budapest (HU); Balazs Gerber, Budapest (HU); Balazs Nemeth, Budapest (HU); Laszlo Pongracz, Szombathely (HU)

(73) Assignee: Polaritas-GM Kft., Budapest (HU)

( * ) Notice: Subject to any disclaimer, the term of this patent is extended or adjusted under 35 U.S.C. 154(b) by 136 days.

(21) Appl. No.: 14/414,932

(22) PCT Filed: Jul. 10, 2013

(86) PCT No.: PCT/HU2013/000066

§ 371 (c)(1),
(2) Date: Jan. 15, 2015

(87) PCT Pub. No.: WO2014/013280

PCT Pub. Date: Jan. 23, 2014

(65) Prior Publication Data

US 2015/0209685 A1 Jul. 30, 2015

(30) Foreign Application Priority Data

Jul. 16, 2012 (HU) ..... 1200144 U
Jul. 16, 2012 (HU) ..... 1200145 U

(51) Int. Cl.
*A63K 3/02* (2006.01)
*B63C 3/10* (2006.01)

(52) U.S. Cl.
CPC . *A63K 3/02* (2013.01); *B63C 3/10* (2013.01)

(58) Field of Classification Search
CPC ..... A63K 3/02; B63B 3/10
See application file for complete search history.

(56) References Cited

U.S. PATENT DOCUMENTS

| | | | | |
|---|---|---|---|---|
| 4,657,403 | A | 4/1987 | Morgan et al. | |
| 5,588,889 | A | 12/1996 | Easter | |
| 2011/0188931 | A1* | 8/2011 | Wrobbel | B63C 3/00 405/1 |

FOREIGN PATENT DOCUMENTS

| | | |
|---|---|---|
| DE | 10323136 | 12/2004 |
| EP | 0805595 | 11/1997 |
| EP | 2105174 | 9/2009 |
| JP | H08112460 | 5/1996 |
| JP | 2001025584 | 1/2001 |
| SU | 503582 | 2/1976 |

OTHER PUBLICATIONS

European Patent Office, International Search Report and Written Opinion of the International Searching Authority, Jan. 28, 2014.

* cited by examiner

*Primary Examiner* — Benjamin Fiorello
(74) *Attorney, Agent, or Firm* — Wood Herron & Evans LLP

(57) ABSTRACT

The invention is a base module for a starting apparatus of sport-purpose flatwater boat competitions, comprising a longitudinal holder arranged crosswise to the direction of motion of the boats, a level adjustment unit, a dynamic stabilizer, and a remote controlled start permitting unit having a mechanical drive unit. According to the invention, the longitudinal holder (2) is made of one or more rigid, hollow pipe or profiled bar.

35 Claims, 8 Drawing Sheets

BASE MODULE FOR A STARTING APPARATUS OF BOAT COMPETITIONS

This application claims priority, under Section 371 and/or as a continuation under Section 120, to PCT Application No. PCT/HU2013/000066, filed on Jul. 10, 2013, which claims priority to Hungarian Application No. U1200144 and Hungarian Application No. U1200145, both filed on Jul. 16, 2012.

TECHNICAL FIELD

The invention relates to a base module for a starting apparatus of sport-purpose flatwater boat competitions, said base module comprises a longitudinal holder arranged crosswise to the direction of motion of the boats, a level adjustment unit, a dynamic stabilizer, a remote controlled start permitting unit having a mechanical drive unit.

BACKGROUND ART

In the past 15-20 years, it has become a practice to use an automatic starting apparatus at flatwater world championships, primarily at kayak and canoe competitions, which follow pre-set courses. The automatic starting apparatus is composed of a series of surface buoys, loud-speakers and a remote controlled start permitting head smashing into the water practically synchronously with the starting signal of the competing boat units, which are identically configured for each boat unit.

FR 2 671 017 provides the principle of the automatic systems. This solution has facilitated the start of the boat units on the same start line, however, its practical realization has been effected by underwater ground conditions being the source of numerous difficulties and uncertainties.

In JP 8112460 an automatic boat starting and an apparatus for the realization thereof are also described. The apparatus is located underwater, its start permitting unit is automatically released, and it is extendible by modules. A disadvantage thereof is that the level adjustment of the start permitting unit is rather difficult, and is dependent on the water level and ground conditions. It is not positioned relative to the water surface.

In JP 2006238959 the intervention is realized by means of an electric motor. The motor-driven drive units are fixed to the system disposed on the underwater ground, and the system is positioned by means of ropes. Its disadvantages comprise the difficult assembly and transportation thereof as well as the too many water surface units, which hinder the aesthetics and focused (e.g. TV) broadcasting of the sport competition.

DE 10334136 relates to a system and its solution at the time already known and used at world championships. The disclosed solution essentially positions the underwater grid structure by means of a water surface buoy system and its support ropes. The individual automatic boat start facilitator units can be connected in accordance with the desired number of lanes. The start permitting unit is either pneumatic or motor driven. A complete unit corresponding to a single boat unit is held above the water surface by two buoys mounted at each end point of the two respective cross-supports. The system is mounted onto a grid structure of significant weight. Although its stability is enhanced by its dimensions, nevertheless, it causes significant difficulty in its assembly, transport, moreover, the high material demand thereof significantly increases its price. It is another disadvantage of the configuration of the system, that the remote controlled start permitting unit is installable essentially only in a single determined place of the grid support.

This is a significant disadvantage, especially in view of the fact that the different types of competitions specify various boat distances, which the start permission system has to comply with. Effecting the respective changes is either impossible or completed with great difficulties only. The change or the replacement of the entire system, especially at world championships, has to comply with very tight time restrictions.

In AU 2004100975 a submersible actuator system also positioned by means of buoyancy floats is disclosed. Frame supports of various different lengths are used to cover the racing lane variations of different widths, having amongst its modules various auxiliary modules and a module with a start permission head. The system, in this case, also has a large weight, moreover various module types are required to be transported, stocked, assembled and disassembled. The start permission head is not adjustable within the modules, the individual lane width can only be set by means of additional modules, the relocation thereof requiring significant physical efforts, space and time.

In AU 2008229874, the start gate module elements are installed under the water surface, which although do not make up a rigid system, are installable per se, in great numbers in advance as well, corresponding to the required lane widths. Its respective adjustment is dependent on the ground conditions or requires a prepared ground, furthermore all assembly works, such as its adjustment in relation to the water surface or post adjustment is difficult, which may be required e.g. due to the dynamic impacts, and which may be especially difficult during competitions.

Flatwater boat racing competitions e.g. kayak, canoe and rowing races are held on preset courses, their start has long been launched at the world and olympic championships by means of pre-installed anti-false-start automatic starting apparatuses allowing automatic start.

The start apparatuses are configured with nose supports, each having a respective head portion for receiving a boat, the positioning of which prior to the competition ensures a start on the same starting line. The boat-receiving head portion is mostly operated by above-water-surface or below-water-surface installation, by means of a remotely controlled pneumatic work-cylinder or electric drive. An armed mechanism raises the boat-receiving head portion and brings it underwater at the appropriate time, with the proper speed and to the precise depth—in order that the boat can start without any obstacle.

There is no significant variation in the usual external configuration and hydrodynamic properties of the nose supports. From FR 2671017, the main parameters of generally used present-day starting systems will become evident.

The respective nose supports of JP 8112460 and JP 2006238959 do not have any intelligence, just like the one in DE 10323136.

All nose support solutions are uniform in the patents as well as in practice in that they merely physically block or permit the start. Although this has caused to limit the competitors trying to gain advantage at the start, however, beside the current usual practice it cannot be controlled or excluded.

It is general practice to use gates and/or light signals and/or acoustic signals to assist the start of various sport competitions. Sensors installed into the start machines and starting blocks are generally used at running and swimming competitions, which at the same time give the starting signal for the timing, such as in the case of JP 9299537 relating to swimming pool starting blocks being equipped with sensors. At flatwater boat competitions, which use nose supports for starting the competition, the starting signal is confirmed by means of light signals as well as acoustic signals, moreover, it is customary to transmit umpire instructions relating to the competitors lining-up prior to the start. This is achieved by means of sound and light displays mounted onto separate posts for each competitor, so that every competitor should receive the starting signal at the same time.

A disadvantage of the present practice lies in the installation and transportation of the posts required for bearing the sound and light displays, furthermore, in that the posts protruding from the water visually obstruct e.g. TV broadcasting.

DESCRIPTION OF THE INVENTION

It is our object to further refine an automatic boat starting system by constructing a compact, light, space-saving, inexpensive system, which is easy to assemble, moreover, to further decrease the dynamic impacts affecting the support structure.

The most general solution to achieve this object is provided by a base module according to the introductory paragraph, wherein the longitudinal holder is constructed of one or more rigid hollow pipe or profiled bar.

For the sake of improving the system, we have developed a mechanical construction, which is equivalent to present art systems but has further advantageous properties. The basic idea is to have a high-strength, rigid longitudinal holder constructed so as to enable one or more remote controlled start permitting units to be installed on a crosswise longitudinal holder in such a manner that the actual position depending on the lane distribution of the remote controlled start permitting unit is allowed to be varied, if so required. This base unit, as a base module, can be extended by additional identical base modules.

As a holder element of the mechanical construction, a rigid, hollow, high-strength pipe or profile may be used having a diameter and wall width depending on the distance to be bridged for the task or a holder may be used bundled in at least one point parallel with their longitudinal axes or configured having grooves commonly affixed in at least one zone. It may be formed with a circular or e.g. an oval profile, and various additional pipe profiles, such as hollow section profiles or special profiles with e.g. ribbed, star etc. cross section—hereinafter referred to as profiles—which can be independently used or fitted in a given zone by means of e.g. grooves, or sectional attachment area.

The individual elemental profiles and pipes can be secured to one another by various methods—e.g. by means of braces, common casing, gluing, welding, stapling, or by linking a groove with its counterpart. The crosswise longitudinal holder can be made of a high-strength, rigid material, e.g. steel, aluminium, carbon-lined plastic as well as other plastics.

The thus constructed holder element is the crosswise longitudinal holder of the base module of the boat competition starting apparatus. The basic construction of the base module comprises a longitudinal holder, a remote controlled start permitting unit mounted thereon, a stabilizer holder and mechanical connectors.

The remote controlled start permitting unit comprises a boat receiving unit, a force transmission unit and a drive unit.

A boat-receiving head portion raising above the water surface is fixed—advantageously in a rigid manner—on one end of the force transmission unit. Its rigid attachment is required only for starting the boats, therefore, the connection between the force transmission unit and the boat-receiving head portion can be solved after the start by means of a plurality of mechanical solutions.

The other end of the force transmission unit is secured, advantageously rotatably, by means of an axis perpendicular to the plane of actuation corresponding to the boat-receiving head portion. The drive unit actuating the force transmission is either a pneumatic system or an electric system. In the case of a pneumatic system, at least one air-operated work-cylinder intervenes.

The longitudinal holder and the remote controlled start permitting unit compose the central part of the base module. The force transmission unit determines the motion of the boat-receiving head portion. The force transmission unit and the longitudinal axis of the longitudinal holder are mounted in such a manner that the plane of motion of the force transmission unit is essentially at 90 degree angle with the longitudinal axis of the longitudinal holder.

In case of a concentric construction of the longitudinal holder, the remote controlled start permitting unit is to be secured in such a manner that it should not rotate around the longitudinal axis of the longitudinal holder, and that the engagement should not release despite the high dynamic forces. Advantageously, the transferable remote controlled start permitting unit is fixed by means of a releasable engagement. The remote controlled start permitting unit is fitted to the crosswise longitudinal holder at the lower section of the drive unit by means of a fitting unit. The lower section of the drive unit can also be configured in itself as a fitting unit.

The crosswise longitudinal holder of the base module and the remote controlled start permitting unit are advantageously mounted by means of a fitting unit by a rigid, e.g. a welded engagement, if the series of longitudinal holders according to the widths of the subject flatwater paddling competition lanes is sufficient, and no future lane width modification is required. Naturally, in this case also, intermediate pieces may be used so as to supplement the length of the base module, if posterior modification is required.

The two end-points of the crosswise longitudinal holder are equipped with mechanical connectors. Advantageously, the line connecting the mid-points of the mechanical connectors mounted onto one longitudinal holder end is either normal to the longitudinal axis or parallel with one of the horizontal chords of the circle of smallest radius that can be drawn around the crosswise section of the longitudinal holder. The mechanical connector is unmovingly secured to the longitudinal holder, rotatably or by means of a resilient connection, e.g. a rubber inlay.

In one preferred embodiment of the level adjustment unit, it comprises a stabilizer holder, a vertical level maintainer and a floating load bearing element. The level adjustment unit is required for adjusting the part of the remote controlled start permitting unit at the water-surface.

A stabilizer holder may be installed to one end of the longitudinal holder, parallel to the line connecting the mid-points of the mechanical connectors.

Owing to the solution according to the present invention, i.e. tubular or profiled configuration, the stabilizer holder is crosswise slidable along the longitudinal direction of the longitudinal holder, by avoiding the vertical planes of the remote controlled start permitting unit. The force exerting arms of the stabilizer holder are preferably mounted onto the longitudinal holder by means of a releasable engagement.

A solution for holding the respective in-water weight of the entire base module might be provided by, e.g., a controllable length section, made by connecting in a load bearing manner two floating force-bearers being at a given distance, the width of such a section being less than the distance between the end-point of the longitudinal holder and the edge of the first remote controlled start permitting unit placed thereon, as a level adjustment unit. The stabilizer holder, as part of the given section, may be disposed of a flexible or rigid material or in a manner corresponding to the shape of the longitudinal holder. The longitudinal holder, the longitudinal axis of which is essentially normal to the determinant plane of the level adjustment unit, may be laid onto the section defined by the stabilizer holder, the vertical level maintainer and the floating load bearer. The level adjustment unit may be oriented, fastened, or installed without fastening by means of the elements—e.g. guides, in the case of a stabilizer holder of a flexible material or in case of a rigid stabilizer holder by means of a guide at the lower side corresponding to the operating position of the longitudinal holder—disposed on the mantle of the longitudinal holder.

A preferred solution is provided by the use of a rigid bar for the static stabilizer holder, wherein the stability can be increased by extending the length of the bar corresponding to the static stabilizer holder—by means of symmetric installation.

In case of a resilient material, the vertical level maintainer and the stabilizer holder may be made of a continuous material e.g. a rope or chain.

Preferably, one stabilizer holder corresponds to one base module, having a vertical level maintainer mounted at each respective ends thereof. It is also possible, that if a plurality of base modules are interconnected, a stabilizer holder and/or a vertical level maintainer being disposed at the ends thereof as a combined unit.

A floating load-bearer may be mounted at the end of the vertical level maintainer. The vertical level maintainer may be e.g. a rigid, but adjustable-length bar, or a rope, or a combination of both. The submergence of the system is advantageously controllable by altering the length of the vertical level maintainer. The length of the vertical level maintainer may be adjusted in at least one point—advantageously at its end-points in case of a rope—e.g. by using and securing a pulley. Preferably, the floating load-bearer is a buoy.

At the closing, last base module of a serially interconnected base modules, or when only one base module is used, a further stabilizer is to be installed onto the longitudinal holder, so that the stabilizer holders, and therewith the level adjustment units—except for the two terminal ones—are common and belong to two adjacent base modules.

The use of a single base module is also possible—e.g. when practicing individual start. In this case, this itself means the first and last base module of the entire start apparatus. Individual level adjustment units are advantageously disposed at both end-points of the longitudinal holder, together with its two respective stabilizer holders. In this embodiment, the mechanical connectors do not have any role—and may also be left out, or may be installed nevertheless for the sake of a possible future extension.

The rigid stabilizer holder mounted onto the longitudinal holder may itself be the holder of the mechanical connectors, as well—disposed by way of example onto the endpoints of the stabilizer holder. As both ends of the longitudinal holders of the base modules require mechanical connectors—excluding the use of a single only base module—, at both ends of the longitudinal holder there is identically arranged a stabilizer holder united with a mechanical connector.

Advantageously, the base module may be supplemented by dynamic stabilizers, which serve so as to dampen the spasmodic loads of various different origins. One of the most extreme spasmodic, dynamic loads is caused by regularly recurrent boat start.

In an advantageous solution of the dynamic stabilizer, a single or a pair of fin-like, flat dynamic stabilizer sheet(s) is installed onto the longitudinal holder extending in a radial direction.

One advantageous solution of the dynamic stabilization is a dynamic stabilizer which is rigidly secured in at least one point on the longitudinal holder, in a plane determined by at least one radius of the circle of smallest radius that can be drawn around the section of the longitudinal holder and by the length of the longitudinal holder.

The dynamic stabilizer is a profile exerting a torque in a direction opposite to the rotation of the longitudinal holder around its longitudinal axis, which makes use of the resistance of the medium—i.e. water. It is preferred, if the configuration is mirror symmetric to the axis of the longitudinal holder. In this case, the oscillation around the axis is dampened by a force pair, always in a direction opposite to the direction of motion. The dimension of the dynamic stabilizer in the direction of the longitudinal axis is effective in dampening the longitudinal oscillation, movement of the longitudinal holder.

The aforementioned profile, as a dynamic stabilizer, may be mounted at any point along the longitudinal axis of the longitudinal holder in a slidable manner, stably secured against rotation in such a way that identical profiles are preferably fixed onto both sides of the longitudinal axis. The torque of the profiles mainly depends on the distance from the longitudinal axis, the dimensions of the plate and the speed of its rotation, in the case of a given medium. Preferably, the dynamic stabilizer is a rigid plate with high fluid resistance, which is parallel with the water level at rest, and symmetrical to the longitudinal axis.

The dynamic stabilizer may be configured by the appropriate configuration of the mainboard of the remote controlled start permitting unit and/or the stabilizer holder.

In order to further improve the dynamic stability, there are oscillation dampers disposed, as additional dynamic stabilizers, having identical lengths force arms on both sides of the longitudinal axis, being identically slidable in both directions along the longitudinal axis, from the midpoint of the longitudinal axis of the crosswise longitudinal holder, in given points in the plane of the cross-section of the longitudinal holder and parallel with the horizontal. The additional dynamic stabilizers have small surface and large volume and transmit concentrated forces.

Preferably, the additional dynamic stabilizer corresponds to a statically balanced weight disposed with a force arm of a given axial symmetry. The force pair acting on the longitudinal holder rotating around its longitudinal axis exerts a returning torque, dampens the oscillations.

It is an advantageous arrangement of the additional dynamic stabilizers, if the force pairs arising thereon are at identical distance from the midpoint of the length of the longitudinal holder and are on the same force arm.

It is a preferred embodiment, if the additional dynamic stabilizer is a suspendable container disposed in water, one that is advantageously open at its top or anywhere else, the weight and inert volume of which is given by the water inside.

A further preferred embodiment is provided if the end-points of the stabilizer holder are themselves the suspension points of the additional dynamic stabilizer, as well.

A further supplement of the base module may be an external information module holder protruding above the water surface, which is rigidly secured in such a manner that the extension of the plane determined by the longitudinal axis of the longitudinal holder and the external information module holder is perpendicular to the line connecting the midpoints of the mechanical connectors.

The information module holder is a unit permanently protruding from the water. It is suitable for optionally disposing various loudspeakers, light signals, cameras, and clocks thereon.

The crosswise longitudinal holder is preferably a pipe, which in the present interpretation refers to a hollow closed-wall cross-section. In the case of a pneumatic system, the internal cavity may accommodate the air compartment of the pneumatic system. Inside of the internal cavity, it is possible to route the power supply cables—e.g. pneumatic and/or electric cables—as well as communication cables, i.e. control and information cables. In this case, communication connectors and electric supply connectors may be disposed on the longitudinal holder before the end-points of the longitudinal holder,—via male-female joints—in order to connect the next identical base module.

Alternatively, the tubularly configured longitudinal holder may be formed sectionally sluicably, in an extreme case having the entire longitudinal holder as a single sluice section. The individual sluices may be disposed with openings for the inlet of fluid and/or gas, preferably water and/or air. As a further alternative, the openings are controllable, for a fully open, or fully closed position or between the two. Through the openings, the specific weight of the longitudinal holder is controllably adjustable by means of known solutions, such as a pump or a compressor.

BRIEF DESCRIPTION OF THE DRAWINGS

The exemplary preferred embodiments of the present invention are herebelow described with reference to the following drawings, where.

MODES FOR CARRYING OUT THE INVENTION

Figure 1:
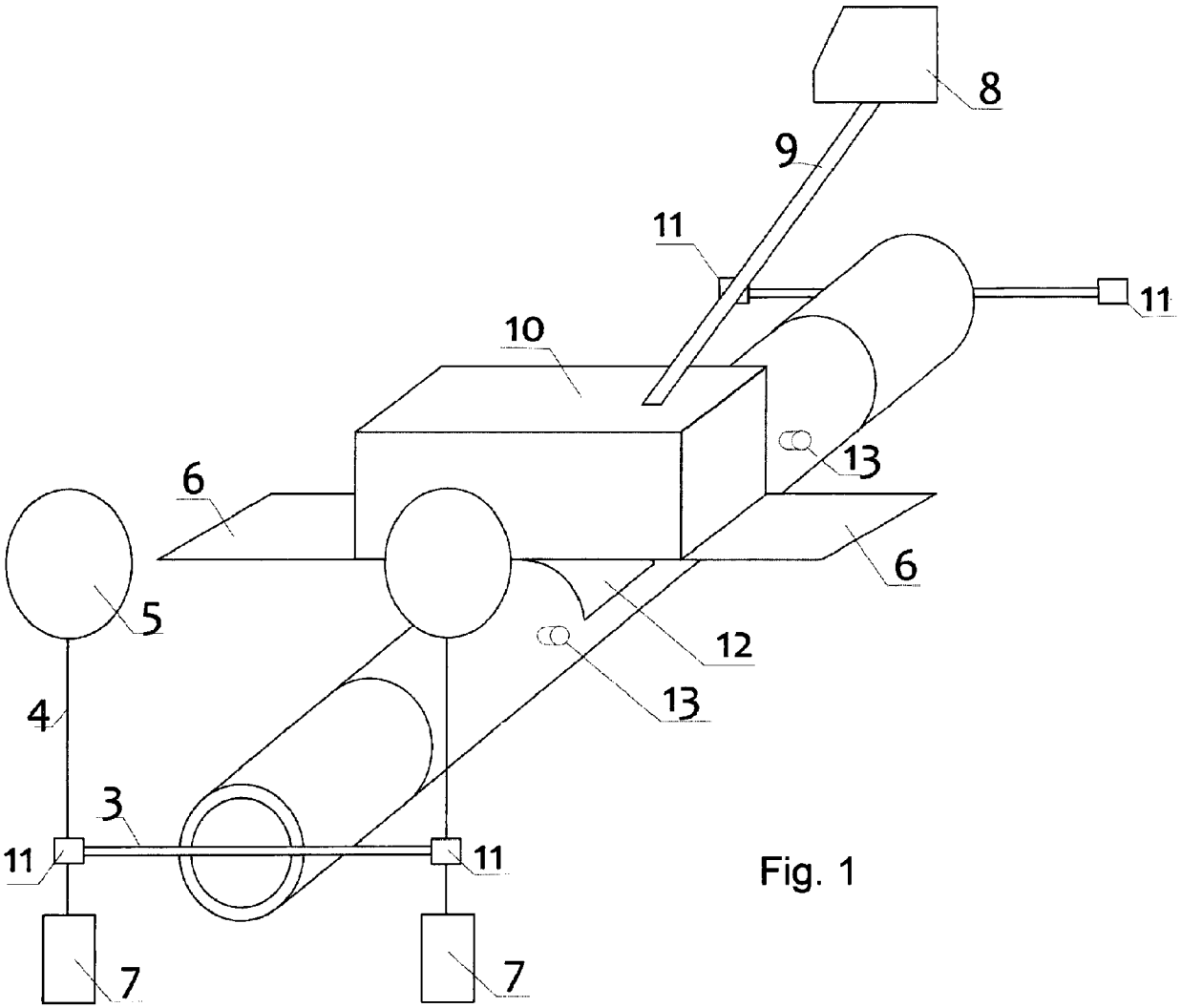
FIG. 1 is a base module mounted with a remote controlled start permitting unit, with a first embodiment of the support structure.

In FIG. 1, the crosswise longitudinal holder 2 is a cross-sectionally hollow steel pipe, its diameter and wall thickness being dependent on the distance to be bridged. Hereinafter, a pipe shall at all times refer to a structural profile cross-sectionally comprising an internal space, a cavity surrounded by a wall, irrespective of its shape.

This embodiment of the longitudinal holder 2 is opened at both ends, therefore the water may flood it in its entire length. In further variations, it may be sluiced section-by-section—e.g. a watertight section may be formed, either permanently closed or having openable/closeable openings 13, in the entire length of the longitudinal holder. Said openings 13 may be formed in the wall of the tubular embodiment of the longitudinal holder 2.

The force transmission unit 9 is a simple rotating arm system, arranged with force arms required for the actuation. The boat-receiving head portion 8 is a simple basket-like technical solution configured for boats, having low resistance, and rising above the water. Prior to the start, it defines and closes the start line for the boats, then submerging at a given time, it physically opens the course in front of the boat.

The head portion 8 is rigidly mounted to one end of the force transmission unit 9. In our example of the drive unit 10 operating the force transmission unit 9, it is equipped with a pneumatic work-cylinder—not illustrated—actuating the force transmission unit 9.

For the releasably securable connection of the lower side of the drive unit 10 and the longitudinal holder 2, there is provided a fitting unit 12. For this, an inclined abutting plate may be used engaged by means of a screw or otherwise, nonetheless it may be secured by means of a pipe-clamp-type of ferrule engagement. In this latter case, the drive unit 10 may be secured onto the linearly homogenous pipe in any arbitrary crosswise direction.

The surface of the longitudinal holder 2 and the lower side of the drive unit 10 define the configuration and fixing method of the connection surface of the fitting unit 12. In our example, the longitudinal holder 2 is a cylinder of circular cross section, an arc of its mantle determining one side of the fitting unit 12 preferably fitting thereon, whilst its other side is given by the surface of the lower side of the drive unit 10—in this case a plane surface.

The fitting unit 12 may be sized as the holder of the drive unit 10, by way of example with a ribbed configuration. Its respective width should preferably equal or be less than the width of the drive unit 10. The width of the fitting unit 12 is preferably smaller than that of the drive unit 10, as it determines the possibility of sliding.

As releasable engagement of the fitting unit 12, e.g. a screw, twistable latch, or strap may be used. The fitting unit 12 and the underside of the drive unit 10 are preferably secured by means of an unreleasable engagement, e.g. welding. The underside of the drive unit 10 may be formed in itself as a fitting unit 12.

By releasing the engagement between the fitting unit 12 and the longitudinal holder 2, the entire remote controlled start permitting unit is slidable parallel to the longitudinal axis of the longitudinal holder 2 in the available length of the longitudinal holder 2, in accordance with the width of the drive unit 10.

In the exemplary FIG. 1, the remote controlled start permitting unit of the base module 1 according to the present invention is illustrated, preferably mounted midway onto a longitudinal holder 2. The remote controlled start permitting unit is slidable parallel with the longitudinal axis of the longitudinal holder 2, or in other cases their number may be increased—advantageously in a proportional distribution.

This solution comprises a level-adjustment unit, incorporating a stabilizer holder 3. The stabilizer holder 3 is suitable for bearing at least its respective in-water portion of the weight of the entire base module 1 disposed in the water.

In the drawing, the stabilizer holder 3 is preferably horizontally installed, normal to the longitudinal axis of the longitudinal holder 2.

In another solution, one that is identical with the exemplary embodiment of the stabilizer holder 3, it is optionally slidable along the longitudinal holder parallel with its longitudinal axis up to a desired position. The stabilizer holder 3 is slidable lengthwise the longitudinal holder 2, being symmetrically mounted onto its mantle, avoiding the planes normal to the axis of the longitudinal holder 2 of the remote controlled start permitting unit.

The length of the stabilizer holder 3 may be increased in order to increase stability.

The mechanical connector 11 is a load bearing element, serving to connect the individual base modules 1.

Preferably, the mechanical connectors 11 are disposed onto a holder, that may be different in length, being parallel with the stabilizer holder 3 mounted onto the longitudinal holder 2, or directly onto the longitudinal holder 2.

In the exemplary embodiment according to FIG. 1, the stabilizer holder 2 is itself the holder of two mechanical connectors 11, in symmetrical arrangement. The mechanical connectors 11 connect the floating load bearing elements 5 applied in this embodiment with the dynamic stabilizers 7 located underneath. Preferably, the stabilizer holder 3 and the mechanical connectors 11 are fixed by means of welding, although other known engagement methods may also be used.

The level adjustment unit is composed of the stabilizer holder 3, the vertical level maintainers 4 fixed to its two ends and at least two mechanical connectors 11. In our example, the vertical level maintainers 4 are loadable ropes, while the floating load bearing elements 5 are buoys. One level adjustment unit may correspond to one base module 1, while there may be disposed a level adjustment unit at each of the two respective terminal ends of a plurality of longitudinally interconnected base modules 1.

Preferably, the base module 1 is supplemented by dynamic stabilizers 7. The dynamic stabilizer 7, as an additional dynamic stabilizer 7, is a pair of compartments open at their top sides, symmetrically positioned under the water level, preferably in consideration of the longitudinal axis of the longitudinal holder 2 as an axis of rotation, and being suspended at identical radial distances from the longitudinal holder 2.

In our exemplary embodiment, the end points of the stabilizer holder 3, themselves are at the same time the suspensions of the dynamic stabilizer 7. In other preferred embodiments, the dynamic stabilizer is lengthwise slidable along the longitudinal holder 2, symmetrically to the axis of the longitudinal holder 2, with a force arm and weight depending on the application.

In our exemplary embodiment according to FIG. 1, the dynamic stabilizer 6 is given by the extension of both sides of the lower half of the drive unit 10 positioned in the midpoint of the longitudinal holder 2. Preferably, the dynamic stabilizer 6 is placed symmetrically on the midline of the longitudinal holder 2.

A further variation of our exemplary embodiment according to FIG. 1 is when the longitudinal holder 2 is composed of a sectionally sluiced pipe or one sluiced in its entirety. Preferably, the pipe which is realized as a longitudinal holder 2 is assembled of a plurality of longitudinal pieces. The pipe section in FIG. 1 may also be an intermediate sluiced member, a closable section, which may be filled up, or depleted through the openings 13 admitting the water or gaseous medium. Using the exemplary intermediate pipe section as a permanent section—fillable with e.g. air—may be realized without the openings 13 admitting the water or gaseous medium.

Figure 2:
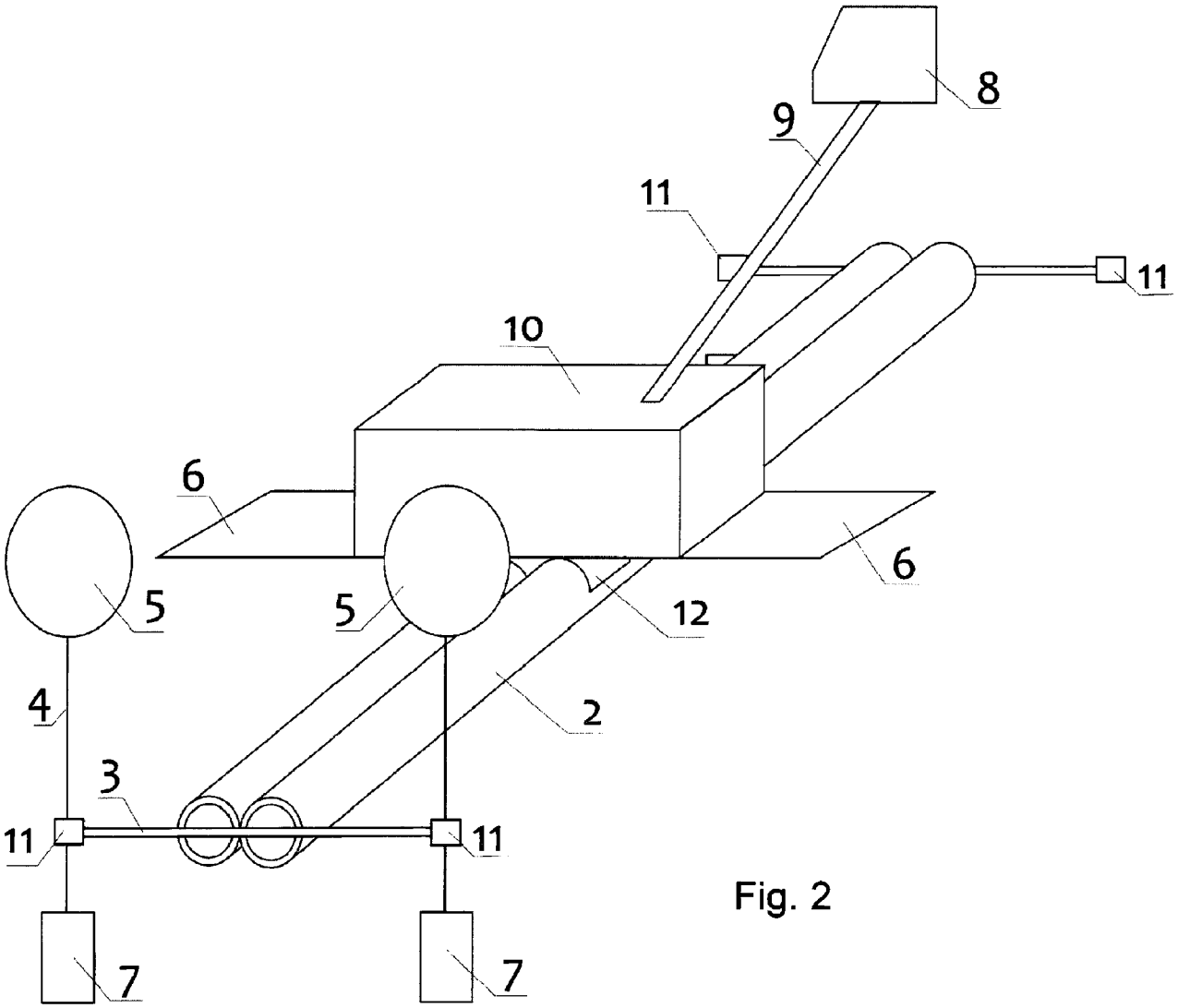
FIG. 2 is a further embodiment of the support structure, having two crosswise longitudinal holders.

Our exemplary embodiment of FIG. 2 is an example of a configuration of a longitudinal holder 2 being made up of a plurality of profile elements. The longitudinal holder is provided by connecting the exemplary two profile elements, in the present case pipes. In this case, the longitudinal holder is made up of two pipes arranged directly adjacent to one another. The two pipes may be offset at a certain distance from one another, in which case, these may be crosswise connected by means of mechanical connecting elements, such as staples, consoles, spacers, etc. Alternatively, it is also possible that the two pipes are not parallel with one another but are arranged at an angle.

Figure 3:
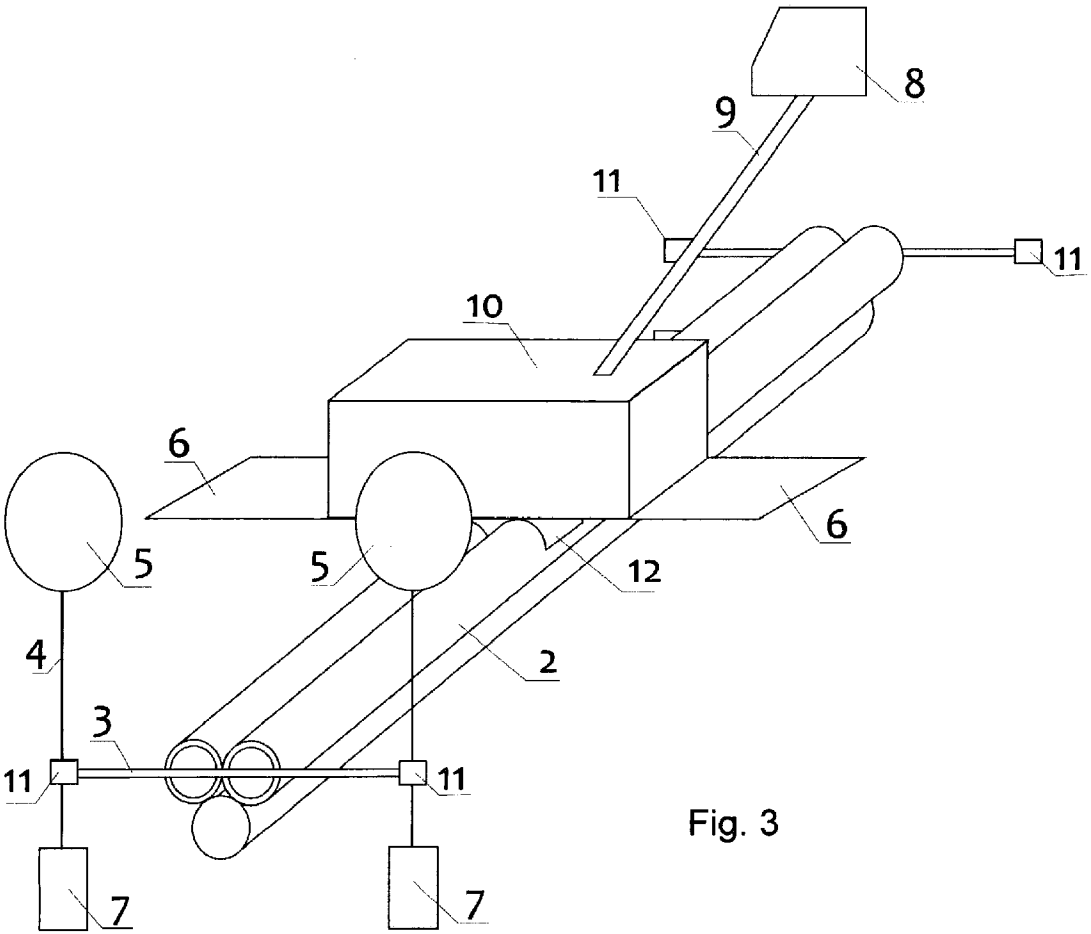
FIG. 3 is a further embodiment of the support structure having three crosswise longitudinal holders.

FIG. 3 shows a further embodiment of the support system. The longitudinal holder 2 is provided by connecting the exemplary three profile elements, in the present case pipes. The holder of the mechanical connectors 11 are in our example made of a rigid material. A further possibility for connecting the elemental profiles or pipe components of the longitudinal holder 2 is by releasably fastening the holder of the mechanical connectors 11 mounted onto both end points of the longitudinal holder 2 to each of the two upper pipes/profiles, while the lower pipe/profile is releasably secured to the end points of the two upper profiles.

In our exemplary embodiments according to FIGS. 2 and 3, the holder of the mechanical connectors 11 is preferably itself the holder of the stabilizer 3, as well.

The fitting unit 12 located at the lower part of the drive unit 10 is configured in a manner that it follows the surface of the two upper profiles of the longitudinal holder 2 and is fastened by means of a releasable engagement, e.g. screws. It is an advantageous effect of the exemplary embodiment of the longitudinal holder 2 according to FIG. 2, that it blocks the rotation of the remote controlled start permitting unit around the longitudinal axis. It is a further advantage of this configuration that the profiles of the longitudinal holder 2 are individually transportable, and constitute more easily movable units, furthermore their assembly does not require significant time input. Preferably, the three profiles of the longitudinal holder 2 are filled with water after being submerged into the water. In a further advantageous embodiment, one or two profiles are configured partially or entirely filled with air, e.g. both ends having tightly plugged configurations.

In the exemplary embodiment of FIG. 3, the two upper pipes of the longitudinal holder 2 are open, while the lower profile is a—preferably air-containing—pipe plugged at both ends. Further reference symbols and comments are the same as those described in regard of FIG. 1.

Figure 4:
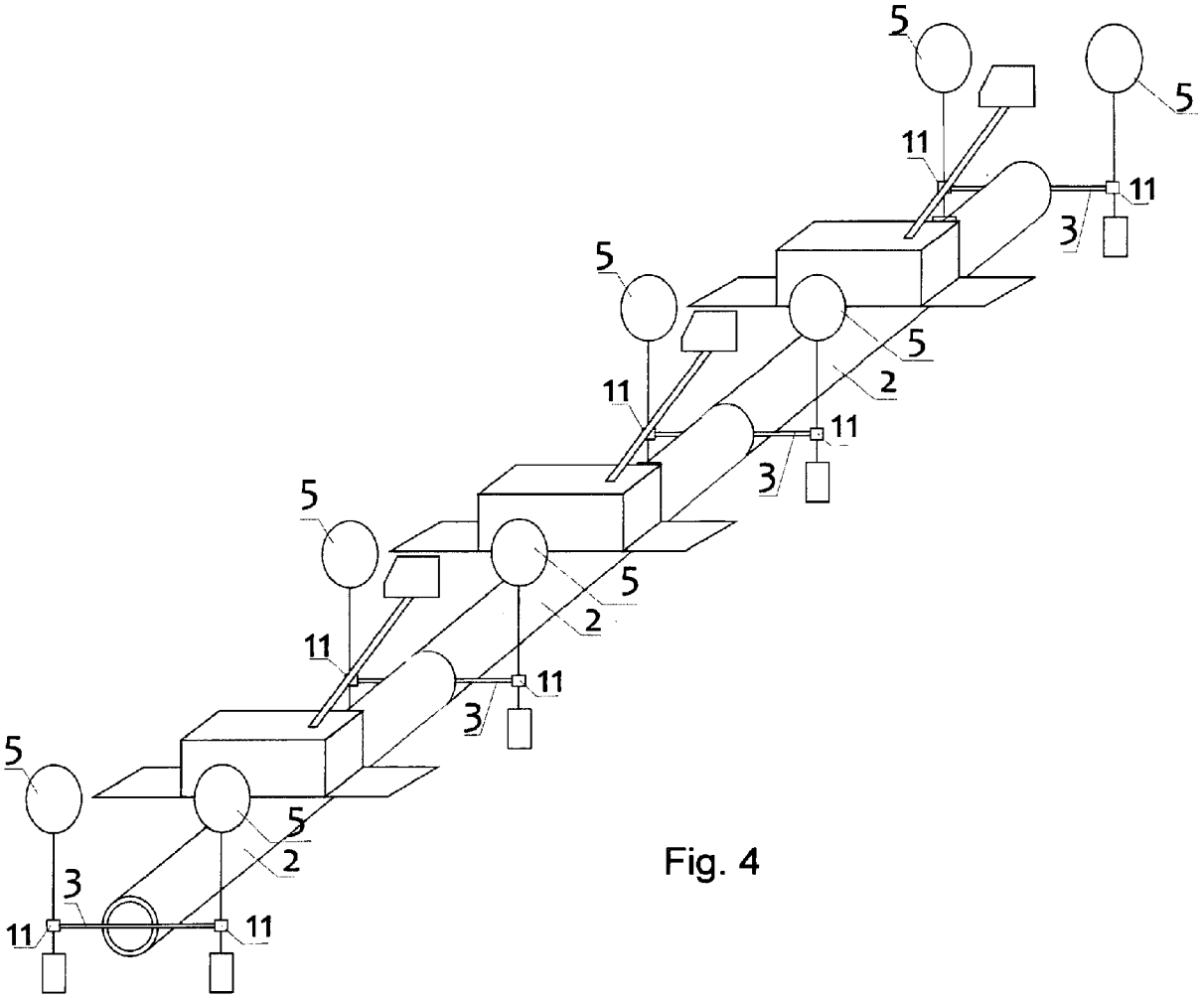
FIG. 4 is a remote controlled start permitting system having by way of example three, longitudinally incorporated base modules.

FIG. 4 illustrates an exemplary embodiment of three serially connected identical base modules according to FIG. 1. Each base module 1 belongs to a different lane, therefore each remote controlled start permitting unit is positioned in the middle of the respective individual longitudinal holder 2, nonetheless it could also be secured at a different position, in a given case. These are all due to the linearly homogenous cross-sectional profile of the longitudinal holder 2.

By means of approximately aligning the longitudinal axes of the longitudinal holder 2, the base modules 1 are secured to one another through their mechanical connector 11 pairs.

In our example, the stabilizer holder 3 is itself also the holder of the mechanical connectors 11.

All stabilizer holders 3 are under load. Two respective level adjustment units belong to each base module 1, and those sides of the base module 1 that are joined by means of the mechanical connectors 11 have common level-adjusters.

In a further embodiment, the longitudinal holder 2 is one or more pipe having in its hollow internal part an electric motor, which operates the drive unit 10.

The operation of the system is described on the basis of FIGS. 1 and 2. In our example, the fitting unit 12 is secured to the lower part of the drive unit 10 by means of an unreleasable engagement. The position of the drive unit 10 of the remote controlled start permitting head portion 8 is marked on the longitudinal holder 2, in our example, in its middle.

The fitting unit 12 is secured onto the longitudinal holder 2 by a releasable engagement, e.g. screw engagement. If a permanent configuration is required with not future re-assembly option, the connection between the fitting unit 12 and the longitudinal holder 2 may be replaced by welding.

The depth of the longitudinal holder 2 is adjusted by means of the length of the vertical level maintainers 4 of the level adjustment unit, such that the boat-receiving head portion 8 should appropriately protrude from the water ready to start the boats. After installing and connecting the power supply cables and information cables, the operation of the drive unit 10 through the force transmission unit 9 will cause the head piece to rise above the water level. Upon the starting signal following the line-up of the boat, which signal in a given case will also transmit acoustic and/or light signals on the information support pole, the head portion 8 will be caused to smash into the water as a result of the operation of the intervening cylinder of the drive unit 10.

The oscillations caused by the smashing into the water may be dampened by the dynamic stabilizer 6 and dynamic stabilizer 7 as well.

If different types of competitions are held in a relatively quick succession, requiring different widths of the individual lanes, then a possible solution for readjusting the lane width would be provided in the case of a system liftable by the level-adjustment unit, by releasing and sliding the fitting unit 12 from the longitudinal holder 2 allowing the remote controlled start permitting units to be repositioned or additional start permitting units to be added. By refastening them and with the use of the level-adjustment unit, the starting system is unalterably operable.

In the case of re-assembly with slidable remote controlled start permitting units, the drive unit 10 is preferably configured and used itself as a dynamic stabilizer 6, as seen in our example.

The disassembly and re-assembly, transport, installation as well as adjustment and positioning of the assembled system can be significantly improved, furthermore its price may be reduced by its more preferable configuration as well as less input material. The use of the dynamic stabilizers 6 and 7 can ensure a system which better excludes the environmental impacts.

With the help of FIGS. 5 to 8, we shall further describe such embodiments of the invention, wherein the base module comprises a nose support, which nose support further comprises an information unit and a boat-receiving head portion and which is connected to the drive unit via a force transmission unit. The object of the embodiments illustrated in FIGS. 5 to 8 is to develop a base module being equipped with a nose support ensuring improved automatic line-up detection and start. The information unit serves to extend the tasks of the nose support of the automatic start facilitating apparatuses used for assisting the line-up and start of the boats competing on set courses, especially by monitoring the start position of the boats. The nose support is equipped with a boat start position sensing unit such that the boat's line-up with a given allowance into the boat-receiving head portion before the start line is transmitted by the start position sensor to the information unit and/or the start supervisory system.

The embodiments of the invention to be described in the following are based on the recognition, that in addition to the mechanical tasks of the nose support—especially in order to avoid any advantage being gained prior to the start—the boat is required to be equipped with further elements, breaking present customs. The use of supplementary sensors, acoustic and visual displays, cable or wireless system could ensure that the competitors are notified from direct proximity, and that the umpires starting the competitors are furnished with additional information, furthermore, the thus established system would also facilitate installation before the competition.

The nose support has a head portion for receiving the boat, a drive unit and a force transmission. The head portion is a unit to block start, then to clear the lane. The head portion is connected to one end of the force transmission, while the drive unit is connected to its other end. The force transmission has force arms, the drive unit is a system driven by means of mechanical or electrical power, preferably by a pneumatic work-cylinder or electric motor.

In order to provide a solution to the set objectives, the nose support may be provided with a start position sensing unit. In another preferred embodiment, it is further equipped with an information unit.

The internal surface of the boat-receiving head portion, especially its part opposite the boat nose, as collision zone serving as the starting line, is in touching contact with the boat body, their continuous contact and the force originating therefrom is dependent upon the wind, waves, boat nose construction, as well as the aggression of the competitor. The configurations of the boat-receiving head portions are uniform in a given competition, while all the boats are differently built. It would be difficult to mount any type of a device onto the racing boats; furthermore, it would carry the possibility of manipulation, as well.

The boat-receiving head portion sets out the starting line for the boats, does not allow the boat to move sideways and clears the race lane at the starting signal. According to the current practice, the boats' lining-up at the starting line is visually controlled by the umpires. Therefore, the present practice has so far not made use of the obvious solution which constitutes the basis of our solution, i.e. that a start position sensing unit be placed at any part of the nose support so as to control the line-up of the boats at the starting line.

The start position sensing unit may be arranged in various ways, disposed at various parts of the nose support, either at the boat-receiving head, or at the force transmission element or at the drive unit.

A number of ways of solutions exist for arranging and installing the start position sensing unit in the boat-receiving head portion. In consideration of the solution of the start position sensing unit, as well as the boats' construction parameters, the path of the lining-up boat, and the configuration of the head portion, the start position sensing unit may be arranged, mounted in any point of the head portion or at an extension thereof.

In a preferred embodiment used by the head portion, the start position sensing unit has a press plate.

Preferably, the press plate is a profile of a rigid planar extension, preferably a plane sheet, which is capable of taking up the force exerted by the lining-up of the boat in the direction of motion or sideward and of transmitting it to the other parts of the nose support. The press plate may be arranged movably and/or rotatably relative to the head portion, or may be arranged essentially motionless.

Movement of the press plate moveable and/or rotatable relative to the head portion is caused by the force exerted by lining-up of the boat body, while the return of the press plate to its initial position is caused by its assembly solutions. In the above-water position of the head portion, the return of the press plate is preferably caused by the gravitational force, resilient force or magnetic force. Gravitational force is a result of the stabile placement of the fulcrum and center of mass, resilient force is resultant upon making use of the spring force or the resilience of the given material, and magnetic force is given by the effect of a permanent magnet on a ferromagnetic material or permanent magnet. One or both permanent magnets may be replaced by an induced coil, preferably one which is controlled. The use of one or a combination of permanent magnets, controlled inductors, controlled and uncontrolled mechanical solutions, is preferable to fix the initial position of the press plate by a small force, so as to ensure that movement of the press plate is only permitted upon a definite force exerted by the boat. Further advantageous configuration of the press plate is made possible by including built-in dampening. The press plate capable of exerting movement may be composed of numerous parts, e.g. equipped with a double-winged gate.

In the case of a solution using a moving press plate, a start position sensor may be at least one of all such solutions, which senses movement, position, terminal-position, force, pressure with or without a touching contact. The terminal position of the press plate may be measured by various methods, inter alia by means of the position of a given part of the press plate, by observing a given position thereof, or if it has a rotational axis, then by means of a detector specifying its rotation or terminal position. In consideration of the wet medium, there are various solutions for detecting the terminal end position, given position, or range to be reached, e.g. by a waterproof mechanical terminal position switch, or induction, capacitive, ultrasonic, optical, radar, laser, magnetic approach switches. Some of these solutions measure the position of the press plate without touching contact, and evaluate the positions mainly adjustably in a given lane, range.

A simple preferred embodiment which can be installed posteriorly, and which is the least influenced by the construction parameters of the boat, is when the press plate is placed with an approximately identical movable surface before the internal front of the boat-receiving head portion, which is held up when the boat is fully lined-up by the front side of the head portion or a part thereof configured as a crosswise holder or a bumper placed on the side walls of the head portion, the movement and the impacts of deformation thereof being measured by known methods.

In another preferred embodiment of the start position sensing unit arranged in the head portion, the press plate and a start position sensor are used. In a preferred embodiment of the press plate, it is pre-stretched and guided, such that upon an external impact, it performs a movement approximately parallel with the internal front surface of the head. This solution may be arranged by the use of e.g. parallel rubber springs.

A further preferred embodiment to be used in the head portion is when the movement and rotation of the press plate is irrelevantly small. In this case, the press plate is advantageously placed in the inside of the head portion, as an element taking up force originating from the boat, wherein the head portion gives the reaction force. Between the press plate and the head portion, there is mounted at least one start position sensing unit, preferably a tensiometric sensor, and which transfers the entire or a given proportion of the force of the press plate to the head portion. Tensiometric sensors preferably have piezoresistive configuration or strain gauge configuration.

An advantageous arrangement of the motionless press plate is provided when the press plate is itself the side of the head portion, and the mechanical connection and force transmission between the press plate and the head portion are partially or fully realized via sensors.

An advantageous arrangement of the motionless press plate is provided when the press plate is itself the front side of the head portion, and the mechanical connection and force transmission between the press plate and the head portion are partially or fully realized via sensors.

An advantageous arrangement, if the start position sensing unit has in at least two horizontal press plate corner points a start position sensor, also serving as a mechanical connection.

A preferred embodiment is provided when the two side faces of the head portion are connected advantageously in its upper part, at the front side of the head portion, by at least one horizontal holder suitable for the transmission of force, a start position sensor being placed on at least one of them. Onto the other side of the start position sensor taking part in the detection there is mounted a press plate. The start position sensor is a sensor indicating load signal and/or terminal position signal. A further part of the press plate, preferably a horizontal lower side thereof, is rigidly mountable to the head portion by e.g. a rotational axis.

Another preferred solution for the detection of the boat's lined-up position, a compressible resilient material is interposed between the press plate and the internal front side of the boat-receiving head portion, by measuring the deformation thereof and/or pressure and/or force we can evaluate the lining-up of the boat or detect a given terminal position, or a closed contact. Terminal position switches should advantageously have minimum hysteresis, connection zone due to the dynamic impacts caused by the slightly swaying system and the waves. In a further preferred embodiment configured in the head portion, the start position sensing unit comprises a start position sensor only, which is advantageously a camera and/or an optical gate and/or ultrasonic sensor and/or radar and/or tensiometric sensor.

A further preferred solution of the set task is to supervise the lining-up of the boat into start position via optical means, by a camera. A press plate is not required by this solution. Preferably, the camera is mounted onto at least one above-water front face or external side face of the boat-receiving head portion, parallel with the internal front face, having an optical axis approximately parallel with the water surface, the viewing angle thereof ranging from the water surface to the upper side of the boat-receiving head portion. Preferably, the signal of the camera is evaluated by means of image processing to decide, whether the boat is located on the starting line according to an appropriate statistical percentage. The start process can be followed by this camera, and the start reaction time may be evaluated. The start can be documented by means of local or central storage of the image signals of each respective start position.

In a further preferred embodiment of the start position sensing unit, the customary infra-light gates or visible light gates or laser gates and sensors are used for direct detection of a given part of the boat, and indirect detection of e.g. movement or terminal position of the press plate. In a preferred application, it is configured with one or more infra gate or laser gate disposed before the front side of the head portion, however, due to the wet environment and contaminations, it has a higher evaluation error rate as compared to e.g. magnetic field sensors.

A further preferred embodiment, if there is mounted at the lower or internal front side of the boat-receiving head portion a resilient cushion filled with gas, preferably air, or a plate or cable, the position of the nose piece of the boat body resting or pressing thereon may be measured and evaluated by means of contact or pressure measurement.

A further preferred embodiment makes use of a plurality of parallel resilient cables, pipes or contact matrix sheets, having an internal part, which switches upon pressure exerted at any longitudinal part thereof, in a direction normal to the direction of motion of the boat.

The boat pushing onto the collision side of the boat-receiving head portion, as well as its force may be measured at the boat-receiving head portion or at the force transmission unit or at the drive unit. The force exerted in the direction of motion of the boat at line-up, may be measured either as pressure or as torque, depending on the device, and may determine the line-up on the start-line, furthermore ensure evaluation of the force based on these measurements.

The load acting on the force transmission from the head portion may be measured by means of built-in tensiometric sensors, preferably by force measuring cells or on the basis of the measurement of deformation of the force transmission. In a preferred embodiment, there is a force or pressure meter mounted at the connection points between the force transmission and the head portion and/or the force transmission and the drive unit. The connection points of the drive unit, which take up additional force and torque, may be used in the same manner e.g. by including a load cell.

A sensor for the electronic processing of the measured force is e.g. a load cell or a force meter cell. The tensiometric sensor may be set to monitor whether e.g. a given value of a force is reached, therefore it is a configuration suitable for detecting start position.

Preferably, following signal enhancement and processing, evaluation of the signals is completed by means of adjustable comparators. A value higher than a minimum force of $F_{min}$ would be a value indicating a lining-up boat, while a value higher than a critical force of $F_{kr}$ would be a value indicating a boat exerting excessive force. The forces of $F_{min}$ and $F_{kr}$ may be adjusted depending on the wind, the waves or boat category.

In another preferred embodiment for detecting the force exerted by a boat body lining up into the head portion, a pressure sensing foil is used, i.e. the internal collision side of the boat-receiving head portion, preferably its internal front side being covered by means of a pressure sensitive material, e.g. piezoresistive pressure sensitive foil. Signal processing of the pressure sensitive material is completed in a manner identical to that of the force meter cell.

At automatic boat starts, the information unit has the task of providing and transmitting information to the competitors lined-up for the start and to the jury, in certain cases to the spectators as well, furthermore, the transmission of signals of devices having information. For this end, the full configuration of the information unit of the nose support is equipped with a visual display, an acoustic display, microphone, cameras and ambient parameter sensors. The information unit may be arranged at any part of the nose support, which is above the water surface directly prior to the start, in such a manner that it provides to the competitors appropriate information, audibly and/or visibly, furthermore without being jeopardized by the boat body. At kayak or canoe races, it is preferably placed at the head portion in such a manner that the visual display as well as the image of at least one camera shall be visible to the competitors.

All parts of the information unit must remain operable promptly after being submerged into the water.

The visual display may be combined with or replaced by individually controlled light sources. The controlled light sources are preferably LED strings of various colors. Preferably the visual displays are placed on the side faces of the head portion untouchable by either the boat or the competitor.

Preferably, the head portion is made of a transparent, rigid material. A further advantageous effect thereof is that the starting umpires can follow the proper line-up of the boats by simple direct observation, moreover, the position of the lining up boats may be recorded and inspected by the external cameras installed at the waterbank. A further advantageous effect of the transparent configuration is the direct transmission of the individual lights. This provides additional possibilities for the use of e.g. the light of light sources not directly placed thereon, e.g. transmission via fiber-glass.

The transparent, preferably polycarbonate, configuration of the head portion, may be caused to light by means of a single light source or a transmitted light, as a light transmitting mantle, and facilitates the lining-up on the start line.

The visible placement of the acoustic display, preferably a loudspeaker, is not a requirement, however, its transmission shall be preferably directly or indirectly aimed at the competitor lining up at a given start position.

The cameras of the information unit shall also be placed in the above-water-surface head portion receiving the boat lined-up for the start. In a preferred embodiment, two cameras are mounted in opposite, 180 degree direction, where the lens of one camera is directed at the competitor already lined-up for the start. The other camera is set on the lane, and the nose support returning after the start may follow the passing boat unit, and may observe and record its course keeping. Longer distances may be supervised by means of remote controllable lenses.

A further preferred embodiment of the nose support is provided with ambient parameter sensors, wherein one or more temperature sensor is measuring the air and water temperature. The temperature sensor is preferably at least one NTC thermistor.

The set objective may be achieved by means of a single temperature sensor—if the temperature sensor is installed into the above-water part of the head portion only, then it can be decided whether the measured value is the temperature of the water or the air, depending on the control status of the drive unit, which operates the head portion.

A wind speed and wind direction sensor may be mounted into the part of the boat-receiving head portion which is in an above-water position at the start. Based on anemometry, the sensors may be e.g. heated platinum filaments or plates.

Preferably, the power supply for the visual displays, acoustic displays, ambient parameter sensors and cameras of the start position sensing unit and of the information unit may be provided by cable from the start supervisory system. It is also feasible to place direct battery operated power supply in the nose support, to serve especially as a short-term power supply.

A preferred embodiment as a wireless solution for the information exchange of the individual parts of the start position sensing unit and of the information unit may be provided by a radio frequency (RF) base. Preferably, the cable connection is a bus system, e.g. customized and/or LIN and/or CAN and/or MOST bus.

The nose support is preferably equipped with a special antenna for transmitting the signals of the start position sensing unit and of the information unit to the supervisory system by means of a wireless solution.

In case of a cable connection, all nose supports to be actually in use may be connected to the bus system independently. The bus system especially supports additional extension of the information units of the individual nose supports as well as the flexible modification of the number of individual nose supports. The wireless and cable configuration may also be used as a redundant solution, if necessary.

The nose support is capable of transmitting all of its signals, such as those of the start position sensing unit and of the information unit to the start supervisory system and is capable of receiving commands issued thereby.

In its most simple configuration, the information unit displays the status of its own start position sensing unit. In the case of using e.g. a single or only a small number of nose support(s) or for the setup, a preferred embodiment could be an information unit displaying the status of its own boat. In a further preferred embodiment, a single information unit displays the signals of each respective start position sensing unit of a plurality of starting boats, simultaneously.

Figure 5:
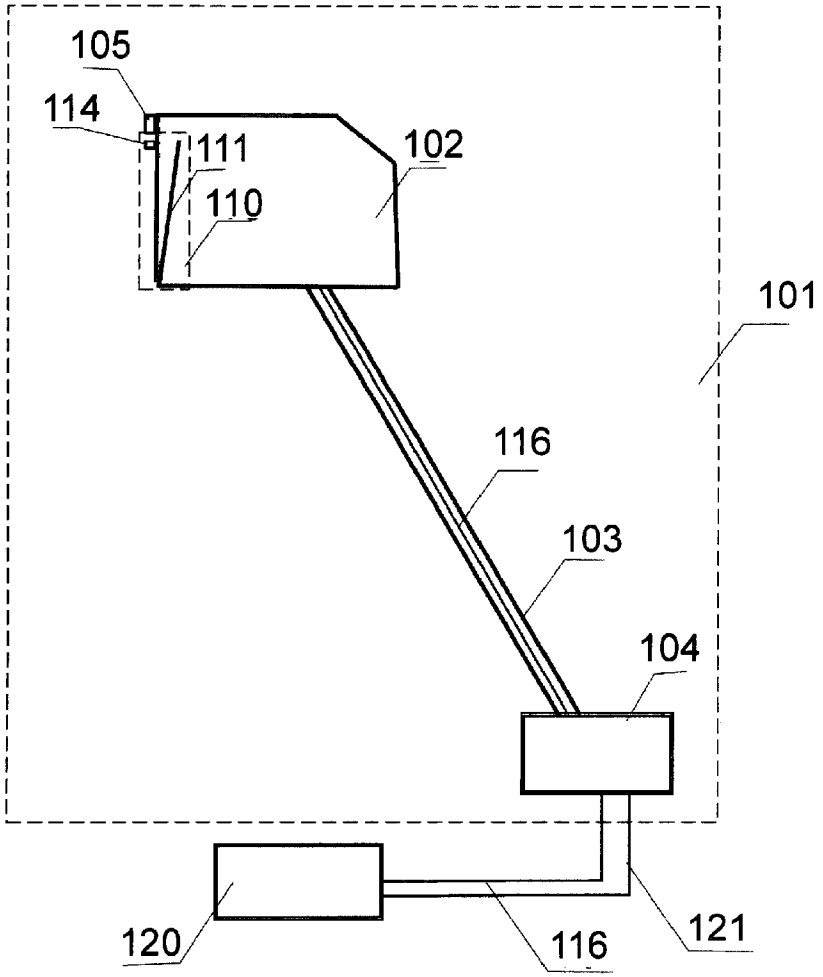
FIG. 5 is an exemplary possible configuration of the nose support in one embodiment of the invention.

FIG. 5 illustrates an exemplary embodiment of a nose support 101. The nose support 101 has a boat-receiving head portion 102, a start position sensing unit 110 and an information unit 105, force transmission unit 103 and drive unit 104. The drive unit 104 is connected to the boat-receiving head portion 102 via force transmission 103. A preferred embodiment of the start position sensing unit 110 is when it has a press plate 111.

The start position sensing unit 110 is mounted onto the front side of the head portion 102, preferably to an internal side thereof or in its plane. In our example, the front side of the head portion 102 is itself the collision surface of the press plate 111.

A further preferred embodiment is when the front side of the head portion 102 is merely a cross piece, limiting the movement of the press plate 111 as a bumper, furthermore bearing the start position sensor 114 as well as the information unit 105. The terminal position of the press plate 111 may be provided by other configurations such as e.g. the side faces of the head portion 102.

The start position sensing unit 110 may be arranged in other positions as well e.g. in an overrun position of the boat, in this case the start position sensing unit 110 according to the drawing is rotated by 90 degrees to the left.

In our exemplary embodiment, the press plate 111 is a resilient plate. In the line of its lower side, the press plate is mounted to the head portion 102 so that it tilts into the direction of the lining up boat, with a surface departing from the vertical by only a few degrees, i.e. with its normal being at a small angle to the directional vector of the motion of the boat. The placement and resilience of the press plate 111 is such that the boat lining up for the start should approach the internal front side of the head portion 102 as best as possible and with the greatest possible surface. Preferably, the shape of the press plate 111 may be a profile with a large surface having an appropriate inclination to suit the purpose, the fastening of the lower points whereof may vary accordingly.

In our exemplary embodiment of the start position sensor 114, a simple mechanical terminal position switch is used, the moving part thereof, when switched, preferably fits into the front side of the head portion 102. Another preferred embodiment of the start position sensor 114 fitting into the front side of the head portion 102, is achieved by the use of e.g. a capacitive or ultrasonic approach switch. In this case it is not required for the press plate 111 to have a metallic configuration. The mechanical terminal end switch contact gives a signal, while the exemplary list of further embodiments have an electronical unit, which has an electrical power demand. An advantage of the electronic units lies in that they have an electronically adjustable sensing range, contact hysteresis.

In our exemplary embodiment according to FIG. 5, the start position sensor may also be a force and/or pressure sensor, which also comprises electronic units.

In the configuration as illustrated in FIG. 5, the front side of the head portion 102 bearing the start position sensor 114 and the information unit 105 is itself also the press plate 111. In this case, the front side of the head portion 102, as a press plate 111, is preferably mounted to the lower side of the head portion 102 in its lower horizontal line, its upper part being supported by a start position sensor 114, the other side of which is mounted to the two sides of the head portion 102 by means of e.g. a cross holder, which at the same time may support the information unit 105 as well. Preferably, the start position sensor 114, in this case, is a sensor for measuring force or pressure.

The information unit 105 in our example according to FIG. 5 has been mounted onto the external part of the front side of the head portion 102. In this case, the front side of the head portion 102 has a size overlapping at least the visual displays of the information unit 105, and is preferably transparent, and has a configuration, which is safe from the boat body.

In a further exemplary embodiment of the information unit 105, it may be placed on the external sides of the head portion 102.

The information unit 105 and the start position sensing unit 110 are connected via a communication cable 116 or RF connection to the start supervisory system 120.

The communication cable 116 provides low output electric power supply and signal transmission to the nose support 101.

The start supervisory system 120 is typically a system installed at the waterbank to monitor the start of all boats equipped with a nose support 101, to control the proper line-up on the starting line in respect of each boat, to start the race, to control the operation of the head portions 102, to gather all possible information as a power and communication center, to give instructions to the crew of each individual boat unit primarily as well as to the assistants, preferably via information units 105.

Preferably, battery-operated electric power supply may be provided, which is at least partially charged by e.g. solar cells, under given circumstances. The start supervisory system 120 is connected to the drive unit 104 by means of communication cable 116 and power transmission cable 121. Preferably, the communication cable 116 is routed via the internal part of the force transmission unit 103. The RF communication of the nose support 101 is preferably implemented by the information unit 105, the counterside unit of which is the start supervisory system 120.

Figure 6:
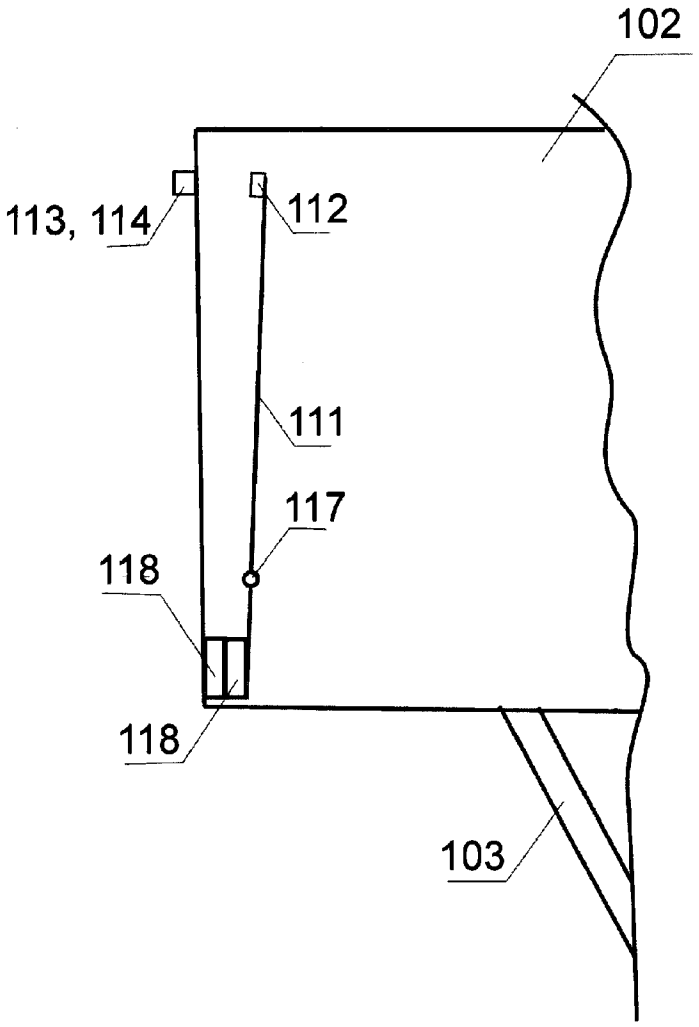
FIG. 6 is an additional example of a start position sensing unit.

FIG. 6 illustrates another exemplary embodiment of a start position sensing unit 110 mounted inside of the head portion 102. The internal front side of the head portion 102 is the side which would be touched by the boat without building the press plate 111 in. The press plate 111 is directly mounted before the front side of the head portion 102 such that by proper line-up of the boat on the starting line, the press plate 111 would touch the front side of the boat-receiving head portion 102. The press plate 111 is made of a rigid planar plate formed with small perforations, holes which do not have any influence upon the sliding of the nose of the boat. It is configured so as to bear the dynamic impacts of the boat.

The press plate 111 has a rotational axis 117, which is horizontal and, in our exemplary embodiment, is positioned in the lower quarter of the height of the press plate 111 in such a manner that it is not physically contacted by the bottom of any of the lining up boats. The two end points of the rotational axis 117 are rotatably fixed by means of the side faces of the boat-receiving head portion 102. In our example, the start position sensor 114 is a magnetic field sensor and a magnet being a part of the detection. The magnetic field sensor, e.g. a Hall sensor, is an AMR—i.e. anisotropic magnetoresistence—or a Reed pipe. The sensor of the start position sensor 114 is preferably placed in the plane of the internal front of the boat-receiving head portion 102, opposite to the magnet 112 mounted as a counterpiece in the upper part of the press plate 111.

The sensor of the start position sensor 114 detects the magnetic field of the magnet 112 placed moving along the upper largest arc of the press plate 111. The sensor of the magnetic field detector 113 is placed on the internal front face of the head portion 102 opposite the magnet 112 such that it should detect the field of the magnet 112 in an approximately parallel position of the press plate 111.

One magnet of the magnetic lock 118 is mounted onto the boat-receiving head portion 102 as a counterpiece of the other magnet mounted onto the press plate 111.

The sensor of the exemplary start position sensor 114 is a Reed pipe attached to two veins of the communication cable 116, transmitting the connecting signal. A further exemplary solution following from FIG. 6 is when a metal plate or disk is mounted in place of the magnet. The sensor of the start position sensor 114 may then be an inductive switch. In this case, the width, diameter and material of the metal plate, as well as the diameter of the inductive switch, moreover, in case of an adjustable electronic device, its setting will determine the connection distance, hysteresis. The pressure acting on the press plate 111 may be detected in itself, in which case capacitive as well as ultrasonic sensors are identically used for the detection, preferably, at the part of the press plate 111 causing the greatest displacement.

Figure 7:
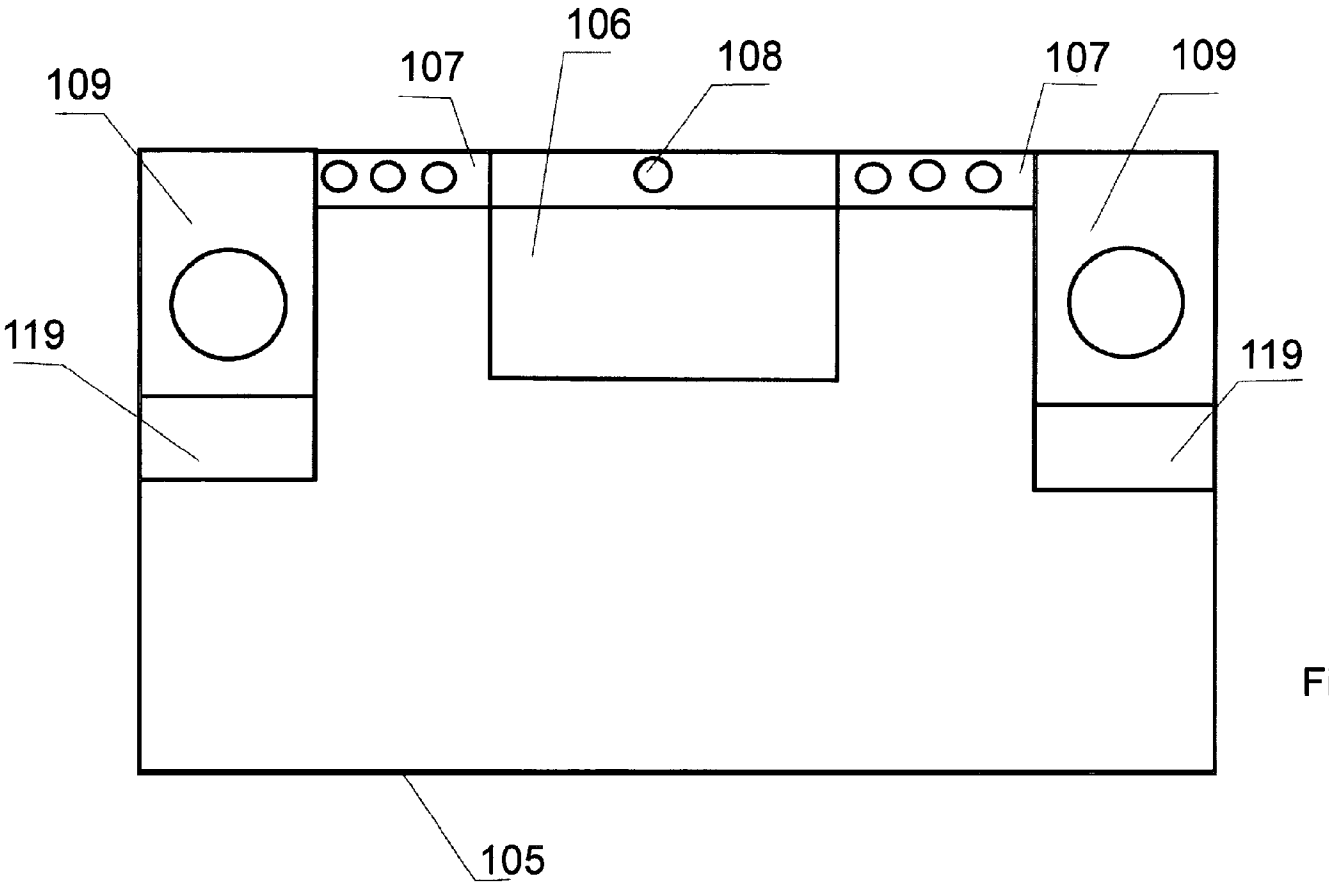
FIG. 7 is an example of an external configuration of an information unit.

FIG. 7 illustrates an exemplary embodiment of the information unit 105.

The information unit 105 is a multifunctional part of the nose support 101, preferably a part thereof integrated into one unit. A majority of the tasks of the information unit 105 arise when the nose support 101 is in an above-water position prior to the start. The information unit 105 has a visual display 106, preferably corresponding to the screen of a computer or a tablet in a waterproof configuration. There is an individual camera 108 or one integrated into the visual display 106, which is preferably mounted onto the uppermost point of the information unit 105 opposite to the starting boat. A further preferred solution of the use of a camera 108 is when another camera 108 is mounted in the direction of motion of the boat, onto the external upper part of the information unit 105. The information unit 105 may be equipped with additional visual displays 106, as individually controlled light sources 107. The individually controlled light sources 107, e.g. LED strings of various colors, are numbers made up of active light sources.

In an exemplary embodiment, there are groups of individually controlled light sources 107 arranged at both sides of the information unit 105. On the internal side of the information unit 105, i.e. on the side visible to the starting competitors, there are color displays arranged indicating at least the start process. On the external half of the information unit 105, e.g. the start numbers of the competitors may be displayed.

The acoustic display 109 is a loudspeaker arranged on one or both internal side of the information unit 105, which plays a significant role at the lining-up and the start.

By means of its ambient parameter sensors 119, the information unit 105 may be made suitable for measuring a plurality of parameters, using individual or multifunctional sensors. The temperature sensor, which in itself may be e.g. an NTC thermistor for taking the temperature of the water and air depending on the position of the boat-receiving head portion 102. By placing a solar cell thereon, information may be provided about the order of magnitude of the lighting and may at the same time to a small extent charge the batteries which serve as power supply.

FIG. 7 illustrates the external schematic exemplary embodiment of the information unit 105 only. Preferably, the information unit 105 comprises radio frequency communication and the necessary signal processing or power supply. The information unit 105 receives the electric power required for its operation via the communication cable 116 or from onboard batteries. Preferably, the information unit 105 is connected with the start position sensing unit 110 via the communication cable or via radio frequency communication so as to transmit its radio frequency signal to the start supervisory system or to the crew of the boat lining up into its respective nose support 101 and/or to maintenance, setup for the direct visual and/or acoustic operation of the information unit 105 belonging to the respective nose support 101 without a start supervisory system. At the same time, this is an advantageous embodiment if a single or a small number of nose support(s) 101 is used, or for the setup.

In its most simple configuration, the information unit 105 displays the respective status of the start position sensing unit 110 of its own boat. In a further embodiment, a single information unit 105 may display the signals of the respective start position sensing units of a plurality of starting boats.

Local data gathering of the information unit 105 may be realized onto e.g. a memory card.

Figure 8:
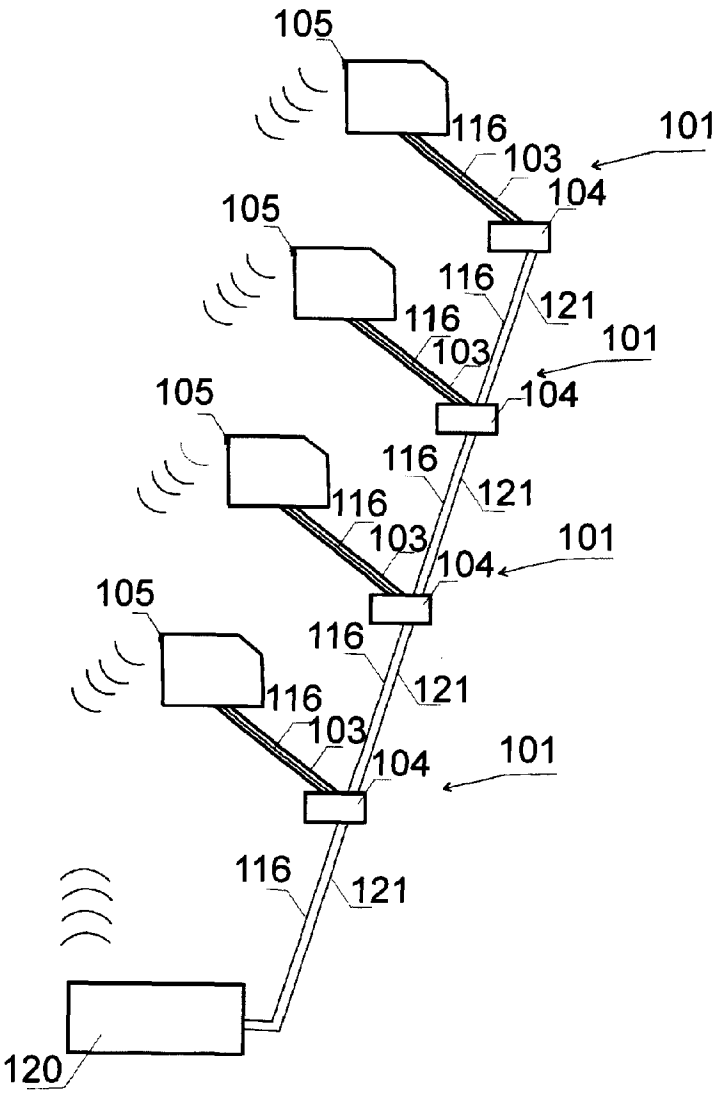
FIG. 8 is a schematic of the nose support and the start supervisory system.

FIG. 8 is an exemplary embodiment of the cooperation of the nose supports 101 of the automatic start units and the start supervisory system 120.

Each remote controlled start permitting unit is equipped with a respective nose support 101.

In practice, the start supervisory system 120 is mostly arranged at the waterbank, to gather all information in respect of the start, to supply the power, to supervise the start and to start the competition and the timing.

The start supervisory system is connected via the communication cable 116 to the drive units 104 and to the nose supports 101. Communication between the individual units is preferably performed via a bus system, therefore, the communication cable 116 is accordingly configured, depending on the speed and distance of signal transmission, and for the purposes of small scale electric power supply. The start supervisory system 120 and the drive units 104 of the individual remote controlled start permitting units 104 are connected via the power transmission cable 121. Depending on their configuration, the drive units 104 operate by means of air or electric power, therefore the power transmission cable 121 is either an air or an electric cable. The drive unit 104 is controlled via communication cable 116.

The information units 105 of the nose supports 101 are configured for RF communication as well.

Between the nose supports 101, as dedicated stations, and the start supervisory system there may be an RF communication. The RF communication system may serve as a redundant system together with the communication cable 116, or may operate independently. In case of a faulty operation of the communication cable 116 of the start supervisory system 120, the system may remain operable as a result of the independent battery power of the nose supports 101 and owing to a starting signal service being sent to the drive unit 104 via the RF communication.

Operation of the nose support is set forth on the basis of the individual exemplary solutions of FIGS. 5 to 8.

In FIG. 5, the nose support 101 is in an above-water position according to the prior-to-start status of the drive unit 104. The press plate 111 is in an initial position. The information unit 105 and the start position sensor 110 provide information to the start supervisory system 120 via communication cable 116 and/or RF communication, furthermore the information unit 105 receives and transmits the commands and signals from the start supervisory system 120. Furthermore, the information unit 105 also transmits the actual status of the start position sensing unit 110—the start position of the boat—via RF communication.

The boat's lining-up moves the press plate 111 towards the start position sensor 114 located within the head portion 102. In case the boat slips, the press plate 111 returns to its initial position due to its resilience. The press plate 111 caused to be at a distance preset at the start position sensor 114, will indicate the boat to be in start position e.g. by means of a closed contact. Switching on and off the start position sensor 114 is realized with a small hysteresis, which may be adjusted depending on the system in the water, thereby decreasing the effects of the individual oscillations, the quick on-and-off switches.

Upon the command of the start supervisory system 120, the drive unit 104 takes the nose support 101 under-water by means of a force transmission. For a re-start, due to its resilience, the press plate 111 located in the boat-receiving head portion 102 returning to above-water position will retract to its initial position.

In FIG. 6 another exemplary embodiment of the start position detector unit 110 is illustrated in a section of a head portion 102.

The initial position of the start position sensing unit 110 corresponds to those described in FIG. 5, however, the press plate 111 is fastened by a magnetic lock 118, therefore, it cannot turn or start improper oscillations around its rotational axis 117. The boat lining up for a start will tilt the magnetic lock from its locked position and thereby the magnet 112 will be caused to approach the start position sensor 114, which will switch on as a result of a given approach of the magnet. The magnetic lock 118 will further exert force, however, with decreasing strength due to the increasing distance between the two magnets. If the boat slips back, the force of the magnetic lock is sufficiently large to move and secure the press plate 111 into its initial position.

FIG. 7 illustrates an information unit 105 of a nose support 101, which, together with the start supervisory system 120 is capable of cable or wireless two-way communication. The lining-up prior to the start as well as the instructions to the competitors are displayed on acoustic display and/or on visual display. Further information may be given directly prior to the start by means of individually controlled light sources 107, giving e.g. red-yellow-green signals on the internal side of the information unit 105. The signals of the individually controlled light sources 107 may be duplicated on the external side of the information unit 105 displaying e.g. lane number, start number of competitors.

The control of the individually controlled light sources 107 is preferably set by the start supervisory system 120.

The camera 108 at the internal side of the information unit 105 may follow from ahead the boat lining up into start position, while the lane and the water surface may be broadcasted by a camera 108 installed externally opposite. After the start, the boat-receiving head portion 108 submerging in water will bring the information unit 105 underwater as well—transmitting underwater images at this time—however after passing of the boat, the nose support 101 returns to its initial position above the water being controlled by the drive unit 104, and then the camera at the external side of the information unit 105 can follow the passing boat, and observe its course keeping.

The camera of the information unit 105 directed at the competitor and the lining up boat, may be used as an independent or control start position sensing unit 110, as an independent boat start position sensor 114. The camera 108 is equipped with an image processor, which evaluates and determines the location of the boat in respect of a given space, start position.

The information unit 105 may also perform the measurement of ambient parameters, e.g. the measurement of temperature. The signal given and processed by means of the NTC sensor is received by the start supervisory system 120 via the communication of the information unit 105. The system determines whether the received data relates to air or water temperature based on the control status of the drive unit 104.

In the system illustrated in FIG. 8, all start position sensing units 110 located in the respective nose supports 101 of each lane have to indicate proper line-up prior to the start to the start supervisory system 120, which will issue the starting signal for starting the competition thereafter only. Upon the starting signal transmitted via communication cable 116, the nose support 101 is caused to be brought underwater by the drive units 104 with the power supplied by the power transmission cable 121, by means of force transmission 103 and local power storages.

A significant advantage of the nose support 101 is its configuration with a start position sensor 110, which will unequivocally ensure proper line-up. The force acting on the boat-receiving head portion 102 to be pushed by the boats by the competitors' is controlled by means of force or pressure sensors.

Another advantage of the nose support 101 is its option of being united with the information unit 105, rendering any need for further accessories e.g. installation of columns per each competitor unnecessary. By the use of local data gathering and the installation of a double communication channel, a more safely operating system may be arranged. A further advantage of the configuration is the abundance of services it is able to provide to the competitors, to the start supervisory system 120 as well as to the spectators and to the mass media.

The invention claimed is:

1. A base module for a starting apparatus of sport-purpose flatwater boat competitions, comprising a longitudinal holder arranged crosswise to the direction of motion of the boats, a level adjustment unit, a dynamic stabilizer, and a remote controlled start permitting unit having a mechanical drive wilt (10, 104), characterized in that the longitudinal holder (2) is made of one or more rigid, hollow pipe or profiled bar and further characterized in that base module comprises a nose support (101), the nose support (101) comprising an information unit and a head portion (102) for receiving the boat, said head portion (102) being connected to the drive unit (10, 104) via a force transmission unit (9, 13), and being equipped with a start position sensing unit (110).

2. The base module according to claim 1, characterized in that the drive unit (10, 104) of the remote controlled start permitting unit is mounted onto the longitudinal holder (2) by means of a releasable engagement arbitrarily slidable along a longitudinal axis of the longitudinal holder (2).

3. The base module according to claim 1, characterized in that the drive unit (10, 104) of the remote controlled start permitting unit is mounted onto the longitudinal holder (2) by means of an unreleasable engagement at a specified location along the longitudinal axis of the longitudinal support (2).

4. The base module according to claim 3, characterized in that there are mechanical connectors (11) along the longitudinal axes of the longitudinal holders (2) for extendably interconnecting a plurality of base modules (1), wherein the ends of the mechanical connectors (11) are releasably secured to one another, and a closing stabilizer is mounted at the end of the terminal members of the serially connected base modules (1).

5. The base module according to claim 1, characterized in that the base module has an information unit, a mechanical connector, a power supply connector and communication connector.

6. The base module according to claim 1, characterized in that mechanical connectors (11) are mounted at the two ends of the longitudinal holder (2) crosswise to its longitudinal axis, and a stabilizer holder (3) is mounted onto one end of the longitudinal holder (2) parallel to a line defined by the mechanical connectors (11).

7. The base module according to claim 1, characterized in that a hollow internal part of the longitudinal holder (2) is configured to accommodate cables of an electrical and/or pneumatic power supply, of a control system and of an information system, and communication connectors and/or power supply connectors are arranged on the longitudinal holder (2).

8. The base module according to claim 1, characterized in that one base module (1) is equipped with two stabilizer holders (3), both ends of which being mounted to one end of a vertical level maintainer (4), the other end of the vertical level maintainer (4) is mounted to a floating load-bearing element (5), and the length of the vertical level maintainer (4) is adjustable.

9. The base module according to claim 1, characterized in that the dynamic stabilizer (6, 7) extends in radial direction and is mounted onto the longitudinal holder (2).

10. The base module according to claim 1, characterized in that the longitudinal holder (2) is a pipe having water inlet openings (13) formed on its surface.

11. The base module according to claim 1, characterized in that the longitudinal holder (2) is formed with sectionally sluicable openings (13) for the inlet of water or gaseous media.

12. The base module according to claim 1, characterized in that the dynamic stabilizer (6, 7) exerts concentrated dampening force and is mounted onto the longitudinal holder (2) positioned symmetrical about its longitudinal midpoint and in a radial direction.

13. The base module according to claim 1, characterized in that the drive unit (10, 104) comprises a pneumatic work-cylinder.

14. The base module according to claim 1, characterized in that the longitudinal holder (2) is a pipe having an air compartment arranged inside its hollow internal part.

15. The base module according to claim 1, characterized in that the longitudinal holder (2) is one or more pipe having an electric motor arranged inside its hollow internal part.

16. The base module according to claim 1, characterized in that the start position sensing unit (110) has a display for displaying sensing of at least its own start position.

17. The base module according to claim 1, characterized in that the start position sensing unit (110) has a display for displaying sensing of start position of a plurality of boats.

18. The base module according to claim 1, characterized in that the start position sensing unit (110) has a start position sensor (114) and a press plate (111).

19. The base module according to claim 18, characterized in that the start position sensor (114) is a sensor for measuring movement and/or terminal position.

20. The base module according to claim 18, characterized in that the start position sensor (114) is a tensometric sensor.

21. The base module according to claim 18, characterized in that the start position sensor (114) is a camera equipped with image processing.

22. The base module according to claim 18, characterized in that the start position sensing unit (110) has a press plate (111) movable by a nose of the boat relative to an internal front surface of the head portion (102) receiving the boat, a magnet (112), a magnetic field sensor (113) and a magnetic lock (118).

23. The base module according to claim 18, characterized in that the start position sensing unit (110) of the boat is a pressure-sensing surface transmitting the pressure signal or particular values of the pressure signal, being located at a part of the boat-receiving head portion (102), which is physically contactable by the nose of the boat.

24. The base module according to claim 1, characterized in that the information unit (105) comprises a visual display (106) and/or an acoustic display (109) and/or a camera (108) and/or an ambient parameter sensor (119).

25. The base module according to claim 24, characterized in that the status of the start position sensing unit (110) is indicated by the visual display (106).

26. The base module according to claim 24, characterized in that the information unit (105) has two cameras (108) mounted in opposite directions, wherein one camera (108) is directed on the competitor lined up into start position.

27. The base module according to claim 24, characterized in that the visual display (106) is a screen and/or individually controlled light sources (107).

28. The base module according to claim 27, characterized in that the light of the individually controlled light sources (107) is guided into the head portion (102) receiving the boat.

29. The base module according to claim 1, characterized in that a wireless and/or cable signal transmission system is arranged between the parts of the information unit (105) of the nose support (101) and/or between the information unit (105) and a start supervisory system (120), as a dedicated station thereof.

30. The base module according to claim 29, characterized in that the information unit (105) as a station of the start supervisory system (120), is capable of transmitting all signals of the nose support (101), as well as receiving the commands of the start supervisory system (120).

31. The base module according to claim 29, characterized in that the remote control signal transmission is within radio frequency range.

32. The base module according to claim 29, characterized in that the cable signal transmission is a bus system.

33. The base module according to claim 1, characterized in that the boat-receiving head portion (102) is made of an optically transparent, rigid material.

34. The base module according to claim 1, characterized in that control system of the drive writ (104) is connected to the start supervisory system (120).

35. The base module according to claim 1, characterized in that the nose support (101) has an ambient parameter sensor (119) for measuring water temperature and/or air temperature and/or wind direction and wind speed.

* * * * *